United States Patent [19]

Evans et al.

[11] 4,113,012

[45] Sep. 12, 1978

[54] RECLOSABLE CIRCULATION VALVE FOR USE IN OIL WELL TESTING

[75] Inventors: Robert T. Evans; David L. Farley, both of Duncan, Okla.

[73] Assignee: Halliburton Company, Duncan, Okla.

[21] Appl. No.: 846,232

[22] Filed: Oct. 27, 1977

[51] Int. Cl.[2] ..... E21B 43/12; E21B 47/00

[52] U.S. Cl. ..... 166/264; 166/321; 166/331; 251/63

[58] Field of Search ..... 166/264, 315, 321, 319, 166/331; 251/62, 63

[56] References Cited

U.S. PATENT DOCUMENTS

| | | | |
|---|---|---|---|
| 2,178,540 | 11/1939 | McNeese et al. | 166/325 |
| 2,951,536 | 9/1960 | Garrett | 166/322 |
| 3,664,415 | 5/1972 | Wray et al. | 166/0.5 |
| 3,703,104 | 11/1972 | Tamplen | 166/240 |
| 3,814,182 | 6/1974 | Giroux | 166/331 |
| 3,837,403 | 9/1974 | Mott | 166/315 |
| 3,856,085 | 12/1974 | Holden et al. | 166/264 |
| 3,964,544 | 6/1976 | Farley et al. | 166/315 |
| 4,063,593 | 12/1977 | Jessup | 166/321 |
| 4,064,937 | 12/1977 | Barrington | 166/321 |

*Primary Examiner*—James A. Leppink
*Attorney, Agent, or Firm*—Floyd A. Gonzalez; John H. Tregoning

[57] ABSTRACT

Disclosed is a circulation valve for use in the testing of an oil well wherein the circulation valve may be reclosed by application of well annulus pressure to allow a subsequent treating or testing program. A spring means is subjected to well annulus pressure on two ends of a volume of fluid. The volume of fluid is divided by a dividing means which includes pressure relief means such that fluid on one side of the dividing means is either higher or lower than the well annulus pressure. This different pressure is applied to one set of a piston means, and the other side of the piston means is subject to well annulus pressure such that movement of the piston means may be controlled by changing the well annulus pressure. An indexing means is additionally disclosed which controls opening of the circulation valve after a selected number of piston means movements, and which closes the circulation valve upon a selected movement of said piston means when the circulation valve is in the open condition.

7 Claims, 9 Drawing Figures

RECLOSABLE CIRCULATION VALVE FOR USE IN OIL WELL TESTING

BACKGROUND OF THE INVENTION

This invention relates to a valve for providing fluid communication between the interior of a tubing string in an oil well and the well annulus surrounding the tubing string. More particularly, the apparatus relates to a circulation valve for use in a testing program for a submerged oil well.

Circulation valves are known for use in a testing program in an oil well wherein the circulation valve opens after a predetermined number of increases in annulus pressure wherein the annulus pressure is exerted against a piston to compress an inert gas in the apparatus for supplying a return spring force. Such a circulation valve is disclosed in U.S. Pat. No. 3,850,250 issued Nov. 26, 1974 to Holden et al and assigned to the assignee of the present invention.

Other valves for use in an oil well are known wherein the valves are operated by changing the pressure differential between the pressure in the annulus of the well and that pressure present in the flow channel in the interior of the tubing string.

A production valve shiftable from one producing formation to another by application of operating pressure changes in the annulus of an oil well is also known as disclosed in U.S. Pat. No. 2,951,536 to Garrett issued Sept. 6, 1960. The disclosed valve includes a chamber precharged with gas and a piston dividing the chamber having orifices through said piston wherein the pressure increases are controlled through said orifice by either metering means or relief valves to provide a resulting pressure differential between a section of the pressure chamber on one side of the piston from a section of the pressure chamber on the other side of said piston. This pressure differential between chamber sections causes the apparatus to shift from a first position to a second position.

The use of a compressible liquid such as silicon oil for supplying return spring force in an oil well apparatus wherein the compressible liquid is metered through a metering means to provide for increases in pressure and temperature in the compressible liquid as the apparatus is lowered into a borehole, and a parallel check valve arrangement in the valve operating mechanism to provide for operating the valve responsive to pressure changes in the well annulus is disclosed in a U.S. patent application to Williamson et al filed on an even date with the present application and assigned to the assignee of the present invention. Also disclosed in the Williamson et al application is an embodiment wherein motion is imparted to the valve operating mechanism upon release of a pressure increase in the well annulus.

Disclosed herein is an oil well apparatus for moving a valve in the well bore from a closed position to an open position wherein the valve which supplies fluid communication from the well annulus to the interior of the testing string may be reclosed subsequent to its opening after a predetermined number of pressure increases in the well.

Movement in a first longitudinal direction is provided by the pressure in the well annulus communicated through the walls of the apparatus and exposed to a suitable piston arrangement. Return movement in a second, opposite longitudinal direction is provided by the pressure of a spring biasing means in the valve operating mechanism which opposes the first longitudinal movement.

The valve operating mechanism is arranged such that the piston means is biased toward the last position to which it has moved during the last pressure change in the well annulus.

Means are provided in the valve operating mechanism for establishing a differential between the pressure of the spring biasing means and the pressure of the well annulus when pressure increases are either applied to or released from the well annulus. The piston means of the valve operating mechanism is arranged to provide either the first or second longitudinal movements responsive to the mentioned pressure differentials.

A counting means in the valve operating mechanism counts the longitudinal movements caused by the well annulus pressure changes, and is arranged for activating the valve operating mechanism to open the oil well valve after a predetermined number of longitudinal movements. Additional counting means in the valve operating mechanism count the longitudinal movements of the piston means after the valve is opened, and is further arranged for activating the valve operating mechanism to reclose the oil well valve after a predetermined number of longitudinal movements while the valve is open.

Means are further provided in the valve operating mechanism for maintaining the mentioned pressure differentials between the spring biasing means and the well annulus for continuing to bias the valve operating mechanism in either the first or second longitudinal directions after the well annulus pressure changes have ceased.

The pressure differential establishing and maintaining means further provide for adding pressure to or removing pressure from the spring biasing means as the apparatus is lowered into or raised from a well bore.

The opening movement of the circulation valve is arranged such that the circulation valve will move to the open position upon a release of a pressure increase. Thus, when the circulation valve is used with the preferred annulus pressure responsive tester valve, the tester valve will open upon pressure increases while the circulation valve is maintained in the closed position. Upon the release of the desired pressure increase, the tester valve will close. After said closing, the circulation valve will open to allow circulation from the well annulus to the interior of the testing string and ultimately to the surface with the formation being tested in a closed-in condition.

THE DRAWINGS

A brief description of the appended drawings follows:

FIG. 1 provides a schematic "vertically sectioned" view of a representative offshore installation which may be employed for formation testing purposes and illustrates a formation testing "string" or tool assembly in position in a submerged well bore and extending upwardly to a floating operating and testing station.

FIGS. 2*a*–2*e* joined along section lines *a*—*a* through *d*—*d* illustrate the invention including a circulation valve section, an indexing section, and a power assembly section.

OVERALL WELL TESTING ENVIRONMENT

During the course of drilling an oil well, the borehole is filled with a fluid known as drilling fluid or drilling mud. One of the purposes of this drilling fluid is to contain in intersected formations any fluid which may be found there. To contain these formation fluids the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus closing in the formation from the hydrostatic pressure of the drilling fluid in the well annulus.

The valve at the lower end of the testing string is then opened and the formation fluid, free from the restraining pressure of the drilling fluid, can flow into the interior of the testing string.

The testing program includes periods of formation flow and periods when the formation is closed-in. Pressure recordings are taken throughout the program for later analysis to determine the production capability of the formation. If desired, a sample of the formation fluid may be caught in a suitable sample chamber.

At the end of the testing program, a circulation valve in the test string is opened, formation fluid in the testing string is circulated out, the packer is released, and the testing string is withdrawn.

The annulus pressure operated method of opening and closing the tester valve, as disclosed in U.S. Pat. No. 3,664,415 issued May 23, 1972 to Wray et al and U.S. Pat. No. 3,856,085 issued Dec. 24, 1974 to Holden et al, is particularly advantageous in offshore locations where it is desirable to the maximum extent possible, for safety and environmental protection reasons, to keep the blowout preventers closed during the major portion of the testing procedure.

The total number of pressure applications of the testing program can be counted, and the tool of the present application is then designed so that each pressure application will incrementally move the apparatus one step toward the opened condition. The disclosed circulation valve will thus not open until the testing program is complete. This concept is also disclosed in U.S. Pat. No. 3,850,250 issued Nov. 26, 1974 to Holden et al and assigned to the assignee of the present invention.

Figure 1:
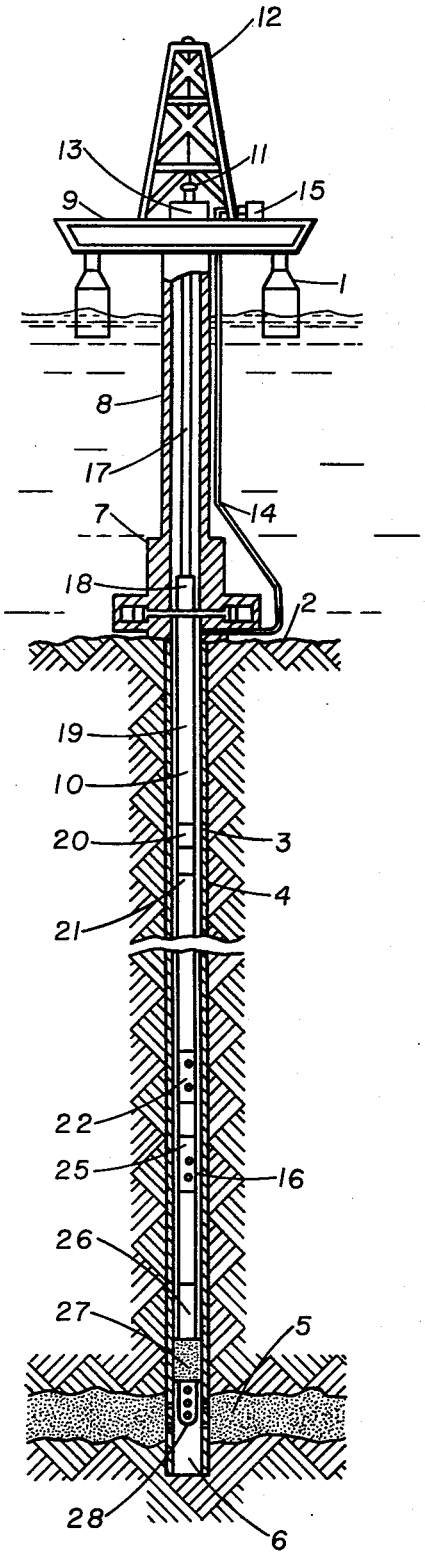

A typical arrangement for conducting a drill stem test offshore is shown in FIG. 1. Such an arrangement would include a floating work station 1 stationed over a submerged work site 2. The well comprises a well bore 3 typically lined with a casing string 4 extending from the work site 2 to a submerged formation 5. The casing string 4 includes a plurality of perforations at its lower end which provide communication between the formation 5 and the interior of the well bore 6.

At the submerged well site is located the well head installation 7 which includes blowout preventer mechanisms. A marine conductor 8 extends from the well head installation to the floating work station 1. The floating work station includes a work deck 9 which supports a derrick 12. The derrick 12 supports a hoisting means 11. A well head closure 13 is provided at the upper end of marine conductor 8. The well head closure 13 allows for lowering into the marine conductor and into the well bore 3 a formation testing string 10 which is raised and lowered in the well by hoisting means 11.

A supply conduit 14 is provided which extends from a hydraulic pump 15 on the deck 9 of the floating station 1 and extends to the well head installation 7 at a point below the blowout preventers to allow the pressurizing of the well annulus 16 surrounding the test string 10.

The testing string includes an upper conduit string portion 17 extending from the work site 1 to the well head installation 7. A hydraulically operated conduit string test tree 18 is located at the end of the upper conduit string 17 and is landed in the well head installation 7 to thus support the lower portion of the formation testing string. The lower portion of the formation testing string extends from the test tree 18 to the formation 5. A packer mechanism 27 isolates the formation 5 from fluids in the well annulus 16. A perforated tail piece 28 is provided at the lower end of the testing string 10 to allow fluid communication between the formation 5 and the interior of the tubular formation testing string 10.

The lower portion of the formation testing string 10 further includes intermediate conduit portion 19 and torque transmitting pressure and volume balanced slip joint means 20. An intermediate conduit portion 21 is provided for imparting packer setting weight to the packer mechanism 27 at the lower end of the string.

A circulation valve 22 of the present invention is located near the end of the testing string 10 as shown. Also near the lower end of the formation testing string 10 below the circulation valve 22 is located a tester valve 25 which is preferably the tester valve disclosed in U.S. Pat. No. 3,856,085. As will be discussed later, each pressure application in the well annulus 16 will open the tester 25 and will move the circulation valve 22 an incremental step toward opening.

A pressure recording device 26 is located below the tester valve 25. The pressure recording device 26 is preferably one which provides a full opening passageway through the center of the pressure recorder to provide a full opening passageway through the entire length of the formation testing string.

It may be desirable to add additional formation testing apparatus in the testing string 10. For instance, where it is feared that the testing string 10 may become stuck in the borehole 3 it is desirable to add a jar mechanism between the pressure recorder 26 and the packer assembly 27. The jar mechanism is used to impart blows to the testing string to assist in jarring a stuck testing string loose from the borehole in the event that the testing string should become stuck. Additionally, it may be desirable to add a safety joint between the jar and the packer mechanism 27. Such a safety joint would allow for the testing string 10 to be disconnected from the packer assembly 27 in the event that the jarring mechanism was unable to free a stuck formation testing string.

The location of the pressure recording device may be varied as desired. For instance, the pressure recorder may be located below the perforated tail piece 28 in a suitable pressure recorder anchor shoe running case. In addition, a second pressure recorder may be run immediately above the tester valve 25 to provide further data to assist in evaluating the well.

DESCRIPTION OF THE PREFERRED EMBODIMENT

FIGS. *2a–2e* show a cross-sectional view of the preferred embodiment. The apparatus 22 includes a circulation valve section 200, an indexing section 201, and a power assembly section 202. The power assembly section has a power piston section 203, a nitrogen chamber section 204, an oil chamber 205, and an oil metering section 206 which is provided between the nitrogen chamber section 204 and the oil chamber section 205.

The apparatus includes an inner bore 40 which extends through the entire length of the tool to give an open bore throughout. The apparatus also has an outer tubular housing assembly including an upper housing adapter 41 having a circulation port 42, an upper intermediate housing section 43, an indexing section housing 44, a lower intermediate housing 45, a power piston housing 46 having power port 47, a passageway housing section 48, a nitrogen chamber housing 49, an oil chamber housing 50 having a pressure port 51, and a lower housing adapter 52.

The circulation valve section 200 shown in FIG. *2a* includes a circulation valve cover sleeve 55 which, in the normal position, sealingly covers circulation port 42. Connected to the lower end of circulation valve cover sleeve 55 is a circulation valve opening mandrel 56 having a port 57 which, in open position, communicates with the circulation port 42 in the upper housing adapter 41. Connected to the lower end of the circulation valve opening mandrel 56 is a lower circulating valve sleeve 58. The circulation port 42 is sealed from the inner bore 40 by upper sealing means 59 and lower sealing means 60 in the circulation valve cover sleeve 55. Sealing means 61 is also provided in the lower end of the lower circulation valve sleeve 58 to prevent contaminants from entering into the index section 201 from the inner bore 40.

Cover sleeve 55, opening mandrel 56 and lower sleeve 58 make up a circulating valve mandrel assembly for valve section 200.

The lower end of circulation valve opening mandrel 56 presents a downwardly directed face 62. An enlargement is provided at the lower end of lower circulation valve sleeve 58 to provide an upwardly directed face 63. A circulation valve operating mandrel 65 is provided having a radially outwardly directed enlargement between the downwardly directed face 62 and the upwardly directed face 63. This enlargement also includes a downwardly directed face 66 to cooperate with face 63 to pull the circulation valve mandrel assembly section 200 toward the closed position, and an upwardly directed face 65 to cooperate with face 62 to push the circulation valve operating mandrel assembly upwardly toward the open position.

As shown in FIG. *2a*, there is sufficient space between faces 62 and 63 that the enlargement at the end of valve operating mandrel 65 may move upwardly and downwardly in this space a limited amount without moving the circulation valve mandrel assembly.

Threadably connected to the lower end of circulation valve operating mandrel 65 is an indexing mandrel 70. Threadably connected to the lower end of the indexing mandrel 70 is a piston mandrel 71 having a power piston 72. It may be seen, as shown in FIGS. *2a–2c*, that the power mandrel assembly comprising circulation valve operating mandrel 65, indexing mandrel 70 and power piston mandrel 71 move as a unit under the influence of a pressure differential on either side of power piston 72.

Upward and downward movement of the power mandrel assembly is controlled by an indexing collar 74 as shown in FIG. *2b*. Indexing mandrel 70 includes a pair of indexing lugs 75 which are located on opposite sides of mandrel 70 and are 180° apart, and which extend into the indexing collar 74 to control the longitudinal movement of the power mandrel assembly.

Indexing collar 74 includes a set of lower indexing teeth 76, a set of middle indexing teeth 77, and a set of upper indexing teeth 78. Two indexing slots 79 are provided 180° apart to allow the indexing collar 74 to be moved into position over the indexing lugs 75 until the lugs 75 are located between the desired sets of teeth. As shown in FIG. *2b*, the indexing collar 74 is loosely held between the lower end 80 of the upper intermediate housing section 43 and the upper end 81 of the lower intermediate housing section 45. The space between the ends 80 and 81, and between the indexing housing 84 and the indexing mandrel 70, is dimensioned to allow the indexing collar 74 to freely rotate as the lugs 75 move between the desired sets of teeth. The design of the teeth and the lugs will be covered later in conjunction with FIGS. 3–5.

A power chamber 83 appears between the inner power mandrel assembly and the outer housing assembly as shown in FIG. *2c*. The power chamber 83 communicates with the annulus of the well exterior of the apparatus through power port 47.

Sealing means 82 are provided in the housing section 45 between the housing section 45 and the indexing mandrel 70 to isolate the indexing collar 74 from the power chamber 83.

The lower portion 84 of the power chamber 83 forms an upper gas chamber portion 84. Power chamber 83 is divided by power piston 72, and sealing means 85 are provided in the power piston 72 to prevent gas in the lower portion 84 of the power chamber from mingling with annulus fluid in the upper portion of the power chamber 83.

An inner tubular sleeve 92 is provided in the inner bore of the apparatus as shown in FIGS. *2d* and *2e* to provide interconnecting gas chambers between the inner sleeve 92 and the outer tubular housing assembly in the area of housing sections 49 and 50.

A main gas chamber 86 is provided between the inner sleeve 92 and the housing portion 49. A gas passageway 87 is provided through the passageway housing section 48 to interconnect the main gas chamber 86 and the lower portion 84 of power chamber 83.

It can thus be seen that pressure which exists in the main gas chamber 86 will be communicated through passageway 87 to the chamber portion 84 below the power piston 72. Well annulus pressure which exists in the annulus exterior to the apparatus will be admitted by power port 47 into the upper portion of power chamber 83 above the power piston 72.

Figure 3:
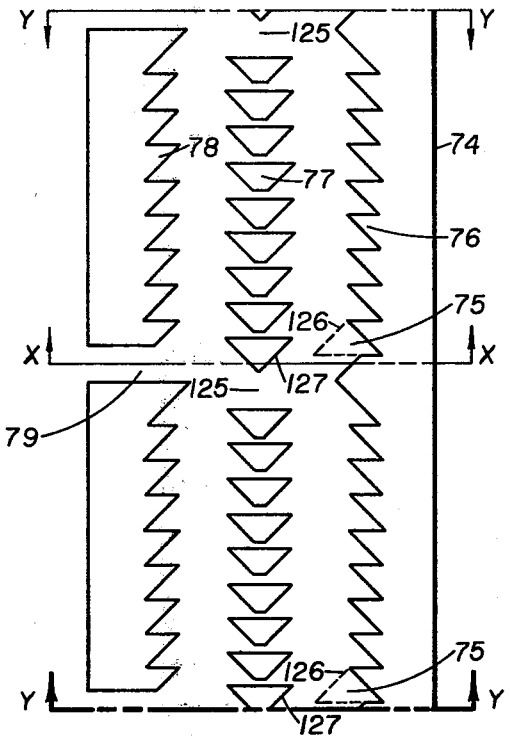
FIG. 3 illustrates the interior of an indexing collar which may be used in the invention, wherein the design of the indexing teeth is shown.

A transverse filler port 88 is provided in passageway housing section 48 to allow an inert gas such as nitrogen to be admitted into the gas chambers through a filler valve as is known in the art. A similar valve which may be used as a filler valve is shown in FIG. 3 of U.S. patent application Ser. No. 769,129 filed Feb. 16, 1977 by Barrington and assigned to the assignee of the present invention. Appropriate seals such as sealing means 90*a* and 90*b* and sealing means 91 are provided to form a fluid tight seal between the gas chambers 84 and 86 and the inner bore 40 of the apparatus.

Figure 2A:
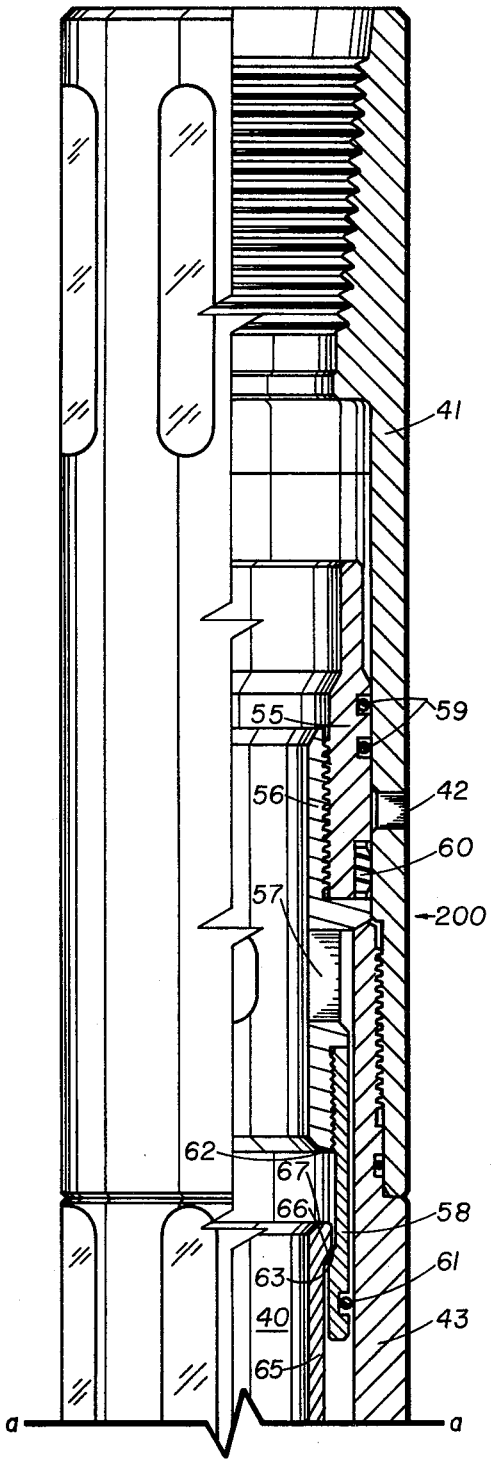
Figure 2B:
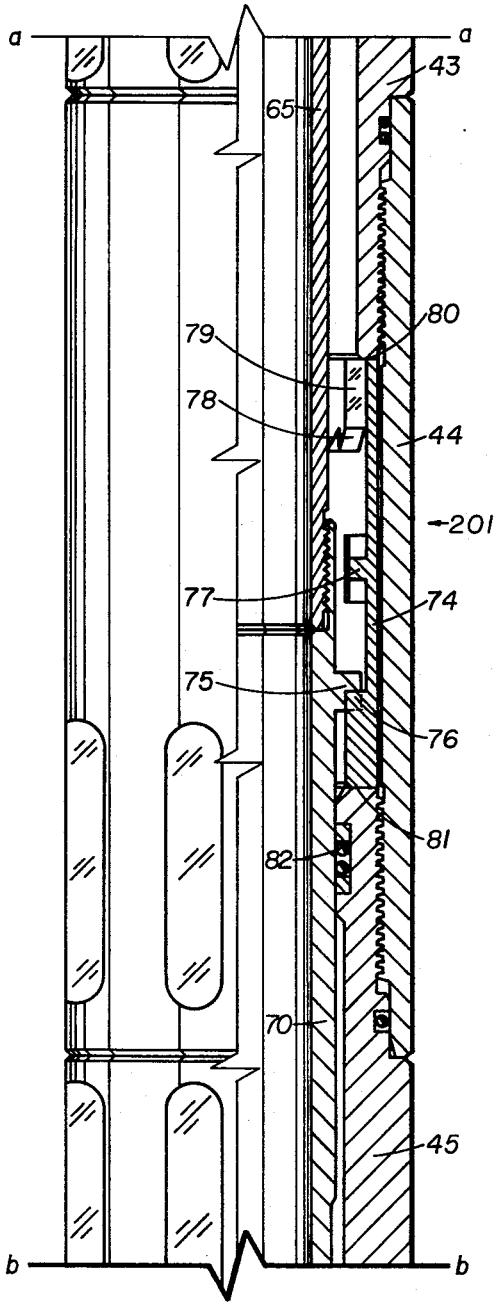
Figure 2C:
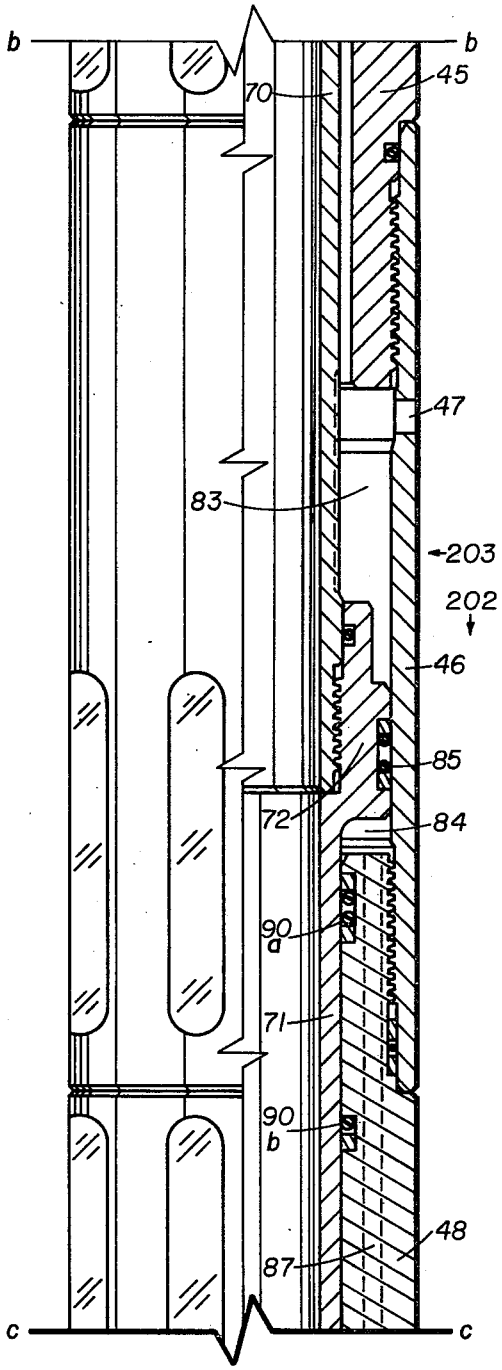
Figure 2D:
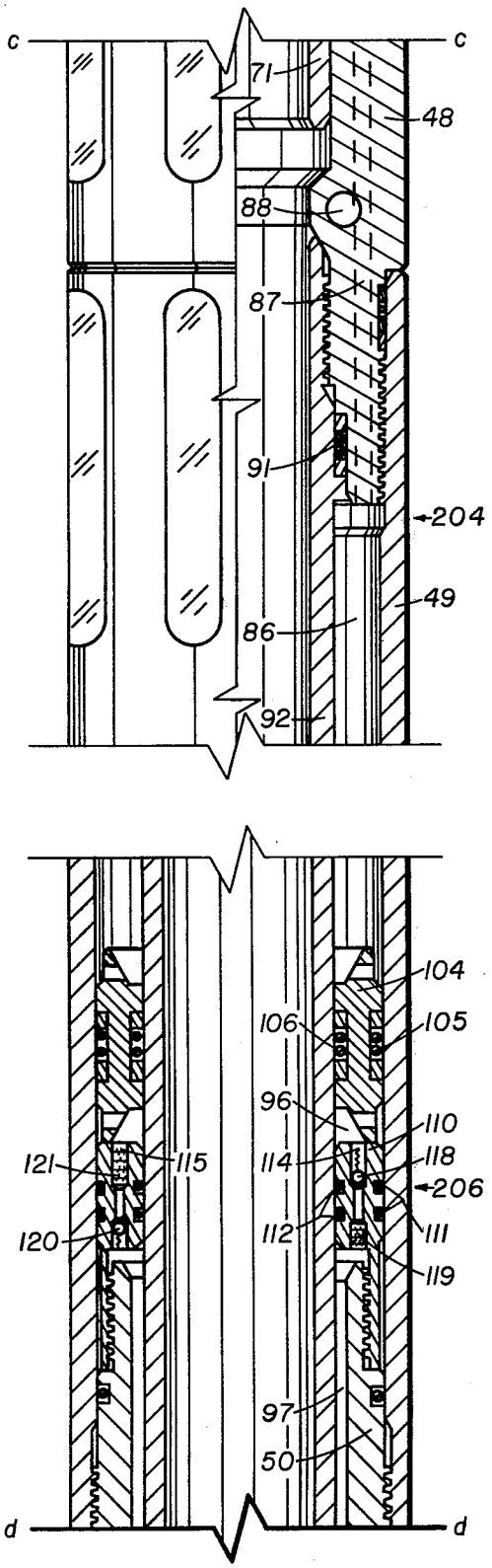
Figure 2E:
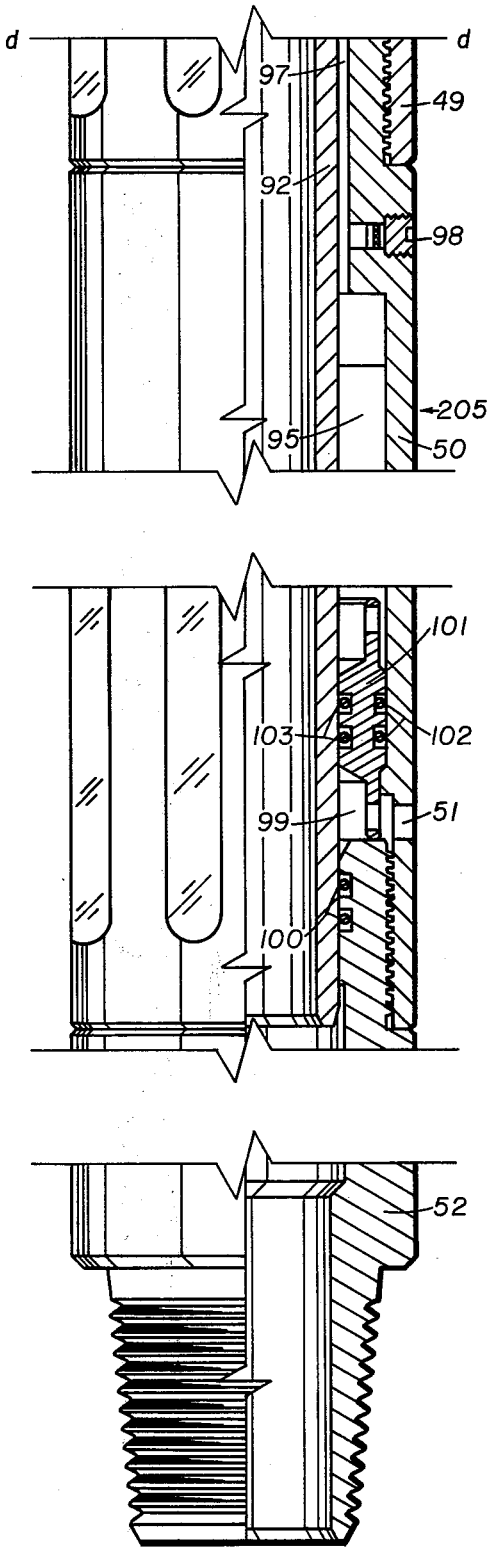

A main oil chamber 95 is provided between the inner sleeve 92 and the oil chamber housing 50 as shown in FIG. 2*e*. The lower portion 96 of the main gas chamber 86 forms an upper oil chamber portion 96. The chamber portion 96 is connected for fluid communication with main oil chamber 95 by an annular oil passageway 97 between the inner sleeve 92 and an upper extension of the oil chamber housing 50 as shown in FIGS. 2*d* and 2*e*.

Oil is admitted into oil chambers 95 and 96 and into flow passageway 97 by means of a filler plug 98 in the oil chamber housing 50.

The lower end 99 of oil chamber 95 communicates with the well annulus 16 exterior to the apparatus by means of pressure port 51 in the oil chamber housing 50 as shown in FIG. 2*e*. Seals 100 are provided to seal chamber portion 99 from the inner bore 40 of the apparatus.

A floating piston 101 is provided in oil chamber 95 to divide the main oil chamber 95 from the well annulus fluid in the chamber portion 99. Seals 102 and 103 are provided in floating piston 101 to prevent well annulus fluid in chamber portion 99 from mingling with the oil in oil chamber 95.

A floating piston 104 is provided in nitrogen chamber 86 and includes seals 105 and 106 to prevent oil in the chamber portion 96 from mingling with the nitrogen in gas chamber 86.

A metering sleeve 110 is attached to oil section housing 50 of the outer tubular housing and is located in chamber portion 96 at the end of passageway 97. Seals 111 and 112 are provided in metering sleeve 110 such that oil in passageway 97 may not flow around sleeve 110, but must flow through two passageways 114 and 115 provided through the metering sleeve 110 for fluid communication between passageway 97 and chamber portion 96. Each passageway includes in series, a pressure relief valve and a metering means for controlling fluid communication through the passageways 114 and 115.

The inlet flow passageway 114 includes a pressure relief valve 118 and a metering means 119. Such a metering means may be a Lee Visco Jet such as is described in U.S. patent application Ser. No. 792,655 filed May 2, 1977 by Baker, and assigned to the assignee of the present invention. The pressure relief valve 118 is designed such that when the pressure exerted on the oil in oil chamber 95 and in the passageway 97 exceeds a given pressure differential with the oil in chamber portion 96, the relief valve 118 will open and the metering means 119 will slowly meter oil from the passageway 97 through the inlet port 114 into chamber portion 96 until the preselected pressure differential is again reached allowing pressure relief valve 118 to close. Pressure relief valve 118 will prevent oil flow from chamber portion 96 into passageway 97.

Exhaust passageway 115 also includes a pressure relief valve 120 and a metering means 121 such as the Lee Visco Jet earlier described. The pressure relief valve 120 and the metering means 121 control fluid flow out of the chamber portion 96 and into the flow passageway 97. Thus, when the pressure of the oil in chamber portion 96 exceeds the pressure in the oil in passageway 97 by a predetermined amount, the pressure relief valve 120 will open and metering means 121 will allow the pressure differential to slowly drop until the predetermined differential between the oil in chamber portion 96 and the oil in flow passageway 97 is again reached. Pressure relief valve 120 will prevent oil flow from passageway 97 into chamber portion 96.

Figure 4:
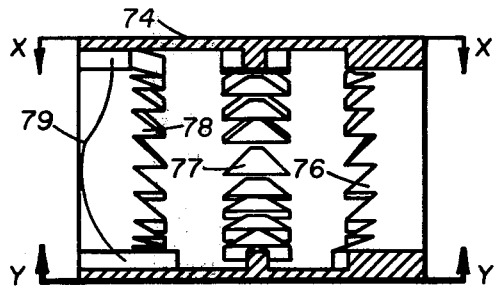
FIG. 4 illustrates a cross-sectioned view of the indexing collar wherein another view of the indexing teeth may be seen.
Figure 5:
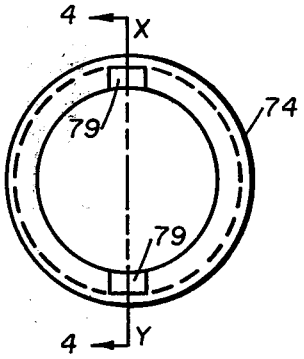
FIG. 5 illustrates an end view of the indexing collar showing the slots through which indexing lugs may be passed to provide access to the indexing teeth.

Turning now to FIGS. 3–5, several views of the indexing collar 74 may be seen. FIG. 3 gives a view of the collar as if the collar were cut longitudinally at section lines *y—y* and rolled out to a flat position so that one could see the indexing teeth design as they would appear from the outside looking inwardly with the outer sleeve portion removed, leaving only the teeth. Lower indexing teeth 76 and upper indexing teeth 78 are provided, and middle indexing teeth 77 are designed to be offset from teeth 76 and 77 such that the indexing lugs 75 on indexing mandrel 70 will move from one set of teeth to the other set of teeth during the reciprocal movement of the power mandrel assembly. When the lugs 75 are between the lower indexing teeth 76 and the upper indexing teeth 77, the lugs will be held in position by the lower indexing teeth 76 when the power mandrel assembly is biased in the downward direction. When the lugs 75 are biased in the upward direction, the lugs will move upwardly to the middle indexing teeth 77 and will bias the indexing collar 74 by the cooperating faces 126 and 127 of the lugs 75 and the teeth 77 respectively, to rotate the collar circumferentially until the lugs come to rest between the middle indexing teeth 77.

This operation may be repeated a predetermined number of times until the indexing lugs 75 reach the slots 125 provided between selected middle indexing teeth 77. When the indexing lugs 75 reach slots 125, the indexing lugs may move further upwardly until its upward travel is stopped by upper indexing teeth 78.

While the indexing lugs 75 are moving between lower indexing teeth 76 and middle indexing teeth 75, the upper end of circulating valve operating mandrel 65 may move between the faces 63 and 62 without moving the circulation valve mandrel assembly. When the lugs 75 move through slots 125, the faces 67 and 62 are engaged and the circulating valve operating mandrel 65 pushes the circulation valve mandrel assembly to the open position such that circulating port 42 communicates with the circulating port 57 in mandrel 56. Closing of the circulation valve is accomplished when lugs 75 move downwardly through slots 125, and faces 63 and 66 engage to pull the circulation valve mandrel assembly downwardly to cover port 42.

FIG. 4 shows a cross-sectional view of the indexing collar 74 showing one half of the collar sectioned at lines *x—x* and *y—y* to give a different view of lower ratchet teeth 76, middle ratchet teeth 77 and upper ratchet teeth 78.

FIG. 5 is an end view of the upper end of indexing collar 74. Shown are slots 79 through which the indexing lugs 75 of the indexing mandrel 70 are passed to provide access between the sets of ratchet teeth 76, 77 and 78. The indexing lugs 75 do not move out of the indexing collar 74 through the slots 79 when the apparatus is fully assembled because of the limited movement of the circulating valve portion 200 when the valve portion moves to the fully open position.

In operation, the gas chamber 86 is charged with inert gas to a pressure less than the sum of the expected hydrostatic pressure of the well at testing depth and the relief pressure of the pressure relief valve 118. The apparatus 22 is then incorporated into a testing string, and the string is lowered into a submerged oil well.

The gas pressure, acting on power piston 72, pushes the power mandrel assembly upward. The indexing lugs 75 may be positioned between teeth of the middle indexing teeth 77 such that the circulation valve section 200 is held in a closed position, and the maximum number of reciprocal movements of lugs 75 between middle teeth 77 and the lower teeth 76 may be made before the slot 125 is reached.

When the annulus pressure, as the apparatus is lowered into the oil well, exceeds the sum of the pressure in chamber 86 and the relief pressure of check valve 118, pressure relief valve 118 opens and oil is metered from chamber 95 into chamber 96 until the pressure in chamber 86 increases sufficiently to reclose pressure relief valve 118. The resultant pressure in chamber 86 is lower than the pressure in the well annulus. The increased well annulus pressure admitted through port 47 into chamber 83 pushes power piston 72 downwardly thereby pulling power mandrel assembly and the attached indexing lugs 75 downwardly. Thus, indexing lugs 75 are then pushed downward between teeth in the lower indexing teeth 76. As described earlier, the circulation valve section 200 is held in the closed position during this movement.

When the testing depth is reached, packer mechanism 27 is set to isolate fluid in the well annulus 16 from the submerged formation 5. The well annulus pressure is then increased to open a preferred tester valve 25, for instance as disclosed in the aforementioned U.S. Pat. No. 3,856,085. This increased annulus pressure causes relief valve 118 to open thus metering additional oil from chamber 95 to chamber 96. This increased oil causes floating piston 104 to move upwardly in chamber 86 compressing the inert gas in chamber 86. Increased well annulus pressure is also communicated to the top of piston 72 in chamber 83, thereby preventing power piston 72 and the attached power mandrel assembly from moving during this increased annulus pressure operation.

The well annulus pressure is then suddenly released to reclose the preferred tester valve 25. This sudden release causes relief valve 118 to close and, after the annulus pressure has dropped sufficiently, for pressure relief valve 120 to open to allow oil to be metered through metering means 121 from chamber 96 to chamber 95. The gas pressure drop in chamber 86 will sufficiently lag the pressure drop of the annulus pressure that the power piston 72 will be moved upwardly, moving lugs 75 to the next teeth in the middle indexing teeth 77.

When the pressure in the well annulus returns to normal and sufficient pressure is bled off by metering means 121, relief valve 120 will close leaving the gas in chamber 86 elevated when compared to the annulus pressure. This elevated gas pressure will hold power piston 72 in the upward position giving an upward bias to lugs 75 against middle indexing teeth 77.

The force needed to move the power piston assembly from one position to another, the area of power piston 72, and the metering rate of metering means 121 and 119 may all be designed such that the preferred tester valve 25 will move from the open to closed position or from the closed to open position before motion is caused in the apparatus 22. Thus, the apparatus may be designed such that the motion of lugs 75 from lower indexing teeth 76 to middle indexing teeth 77 will not occur until after the preferred tester apparatus 25 has moved from the open to closed position upon release of well annulus pressure.

A subsequent increase in well annulus pressure to open the well tester apparatus 25 will be transmitted to the top of power piston 72. When the well annulus pressure increases above the biasing pressure left in chamber 86, a pressure differential will occur across power piston 72 with the higher pressure existing in chamber 83 as transmitted by port 47. This pressure differential will increase until relief valve 118 opens, metering oil from chamber 95 to chamber 96. A sufficient delay is built into metering means 119 to provide time for the power piston in 72 and the attached power mandrel assembly to be moved downwardly, moving indexing lugs 75 from between teeth in the middle indexing teeth 77 to the lower indexing teeth 76. This process may be repeated, reciprocating lugs 75 between indexing teeth 76 and 77 and conducting an oil well testing program, until slots 125 are reached. Sufficient teeth are built into indexing teeth 76 and 77 to provide that a complete testing program may be completed before slots 125 are reached. It will be noted that when well annulus pressure is increased above the pressure in chamber 86, that the pressure differential across piston 72 will bias the indexing lugs 75 downwardly to hold the power mandrel positively in the last shifted-to position.

When slots 125 are reached, a release of the well annulus pressure increase will cause first the preferred testing apparatus to close, and then cause the lugs 75 to move from the lower indexing teeth 76 through the slots 125 to the upper indexing teeth 78. By this motion, circulation valve cover sleeve 55 moves upwardly until port 42 communicates with port 57 thereby opening circulation valve section 200. At this point the formation to be tested 5 is in the closed-in position and circulation of drilling mud may occur between the well annulus 16 and the interior of the testing string to move formation fluid through the interior of the testing string to the surface. Sufficient teeth are provided in upper indexing teeth 78 and middle indexing teeth 77 such that lugs 75 may reciprocate between the upper and middle indexing teeth responsive to pressure variations which may occur during the circulation process. After circulating the testing string may be removed from the well by unseating packer 27, if desired or a new testing program or treating program may be undertaken.

If it is desired to conduct a new test of the formation or if it is desired to treat the formation, the circulation valve may be reclosed. The flow channel through the testing string may be closed at the surface in the vicinity of well head closure means 13, and pressure increases may be alternately applied to the well annulus. These pressure increases cause the indexing lugs 75 to reciprocate between upper teeth 78 and middle teeth 77 until slots 125 are once again reached. After slots 125 have been reached, the indexing lugs 75 may move downwardly closing the circulation valve section 200 and placing the lugs 75 between the middle indexing teeth 77 and the lower indexing teeth 76. The closing of the circulation valve section 200 may be observed at the surface by measuring the pressure of the well annulus 16 and the pressure in the flow channel of the drill string. With the circulation valve section 200 closed, an increase of the well annulus pressure will not be transmitted to the interior of the testing string.

After the circulation valve section 200 has been closed, a new testing program of the formation 5 may be initiated, or if full opening testing tools are incorporated in the string as previously mentioned, a well testing or treating apparatus may be lowered into the well through the fully opened flow channel of the testing string. Additionally, well treating chemicals or materials may be injected through the fully open string into the formation by pumping the chemicals or material through the testing string from the surface. In this case, the pressure operated isolation valve disclosed and described in U.S. Pat. No. 3,964,544 issued June 22, 1976 to Farley et al may be used with the preferred tester valve 25 in order that increased pressures may be subjected to the interior of the testing string without reopening the isolation valve of the tester valve 25. The use of such a pressure operated isolation valve also eliminates the need for mechanically closing an isolation valve prior to the initiation of the described testing procedure as described in the aforementioned U.S. Pat. No. 3,964,544.

In addition to opening and closing a circulation valve section 200 as disclosed, the power assembly section 202 of the present apparatus may be used to operate other types of testing tools in a well annulus such as, for instance, a testing valve. Such a use would eliminate the need for a mechanically operated isolation valve such as that disclosed in the aforementioned U.S. Pat. No. 3,856,085 to Holden et al, and would result in an apparatus wherein the operating force of a gas chamber would be supplemented by the well annulus pressure as the tool is lowered into the well bore such that excessive gas pressures would not be required at the surface.

The foregoing disclosure is intended to be illustrative only and is not intended to cover all embodiments that may occur to one skilled in the art to accomplish the foregoing objectives. Other embodiments which work equally well and are equivalent to the embodiments shown may be imagined by one skilled in the art. The attached claims are intended to cover the embodiments disclosed as well as such equivalent embodiments of the invention which may occur to one skilled in the art.

What is claimed is:

1. A circulation valve apparatus for use in a test string having a flow channel therethrough and extending within a well bore from the surface to a formation to be tested comprising:

a tubular housing having an axial bore therethrough and arranged for incorporation into said test string with said axial bore communicating with said test string flow channel, said tubular housing having a circulation port providing fluid communication between the well bore exterior of said housing and said axial bore;

circulation valve means slidably located in said axial bore and movable between a first position preventing fluid communication through said circulation port into said axial bore, and a second position opening said circulation port and allowing fluid communication through said circulation port into said axial bore;

power mandrel means slidably located in said axial bore;

piston means on said power mandrel means responsive to pressure changes in said well bore for moving said power mandrel means;

operating means between said power mandrel means and said tubular housing for imparting a bias to said piston means for holding said power mandrel means in the last position to which said power mandrel means moved responsive to said well bore pressure changes; and indexing means operatively connecting said power mandrel means to said circulation valve means for moving said circulation valve means from its first position to its second position responsive to a predetermined movement of a plurality of movements by said power mandrel means, and for subsequently moving said circulation valve means from its second position to its first position responsive to a later predetermined movement of said power mandrel means.

2. The apparatus of claim 1 wherein said piston means is exposed on one side to the pressure in the well bore exterior of the tubular housing, and on the other side to a pressure of said operating means; and said operating means comprises means for providing pressure to said other side of said piston means which is one of an amount not greater than a predetermined amount below the highest pressure appearing in the well bore exterior of said tubular housing and a subsequent amount not lower than a predetermined amount above the lowest pressure appearing in the well bore exterior of said tubular housing.

3. The apparatus of claim 2 having an oil filled chamber between said tubular housing and said power mandrel means, a pressure port through the walls of said tubular housing for providing fluid pressure communication between the well bore exterior of said housing and a first end of said oil filled chamber, and pressure in said oil chamber at a second end longitudinally separated from said first end communicated to said other end of said piston means; and wherein said means for providing pressure of said operating means comprises:

dividing means in said oil chamber between the first and the second ends of said oil filled chamber for dividing said chamber into a first portion and a second portion;

a first relief valve means for opening and allowing oil flow from the first portion to the second portion of said oil chamber when the pressure in the first portion exceeds the pressure in the second portion by a predetermined amount, and for closing and preventing oil flow when the pressure in the first portion of said oil chamber falls below a predetermined amount over the pressure in the second portion of said oil chamber; and a second relief valve means for opening and allowing oil flow from the second portion to the first portion of said oil chamber when the pressure in the second portion exceeds the pressure in the first portion by a predetermined amount, and for closing and preventing oil flow when the pressure in the second portion of said oil chamber falls below a predetermined amount over the pressure in the first portion of said oil chamber.

4. The apparatus of claim 3 further comprising:

a first and second metering means in series with said first and second relief valve means respectively for metering oil flow between said first and second portions of said oil filled chamber.

5. The apparatus of claim 1 wherein said indexing means comprises:

an indexing sleeve circumferentially rotatable around the outer periphery of a portion of said power mandrel means;

three sets of indexing teeth, one set around the inside circumference of each end of said indexing sleeve, and one set around the inside circumference at the middle of the indexing sleeve, said middle set of indexing teeth being absent a tooth periodically for providing a passageway from the set of indexing teeth at one end of said indexing sleeve to the indexing teeth at the other end of said indexing sleeve through said middle indexing teeth;

lug means on the outer periphery of said power indexing means arranged to move between the sets of indexing teeth and having faces to engage with said indexing teeth for circumferentially rotating said sleeve when said operating means bias said lug means into engaging contact with said indexing teeth, said lug means sized to move through said passageway provided through said middle indexing teeth for periodically moving said lug means from between the middle indexing teeth and the indexing teeth at one end of the indexing sleeve to between the middle indexing teeth and the indexing teeth at the other end of the indexing sleeve; and wherein said circulation valve means is arranged to be in its first position when said lug means is between said middle indexing teeth and one set of indexing teeth on one end of said indexing sleeve, and said circulation valve means is in its second position when said lug means is between said middle indexing teeth and the other set of indexing teeth on the other end of said indexing sleeve.

6. A method of testing a formation using a testing string within an oil well bore extending from the surface to the formation to be tested, said testing string including a tester valve for opening and closing a flow channel through said testing string responsive to pressure changes in the well bore exterior of the testing string, said method comprising:

lowering said testing string into said well bore;

setting a packer mechanism at the end of said testing string for isolating said formation from the annulus of the oil well between the walls of the well bore and the testing string;

increasing the pressure in the well annulus;

responsive to said pressure increase, opening the tester valve in the testing string flow channel allowing fluid communication from the formation, through the testing string flow channel to the surface;

releasing the pressure increase in the well annulus;

responsive to said pressure release, closing said tester valve for closing-in said formation;

stepping an indexing means in a circulation valve in said testing string above said tester valve, which indexing means maintains said circulation valve in the closed condition until after a predetermined number of steps;

repeating the increasing and releasing pressure steps a predetermined number of times to conduct a formation testing program;

responsive to a predetermined pressure release, opening said circulation valve;

circulating fluid through the well annulus, the open circulation valve and the flow passage in the testing string for displacing fluid in the testing string flow channel to the surface;

increasing the pressure in the testing string flow channel and the well annulus;

responsive to said pressure increase, closing said circulation valve; and repeating the increasing and releasing pressure steps a predetermined number of times to conduct a subsequent formation testing program.

7. The method of claim 6 further comprising, after the closing said circulation valve step, including the steps of:

increasing the pressure in the well annulus;

responsive to said pressure increase, opening said tester valve; and conducting a well treating program through the open flow channel in said testing string.

* * * * *